US006863487B2

(12) United States Patent
Behrens et al.

(10) Patent No.: US 6,863,487 B2
(45) Date of Patent: Mar. 8, 2005

(54) METHOD AND DEVICE FOR TRANSFERRING STORAGE CONTAINERS, PREFERABLY CASSETTES FOR PRINTING PLATES

(75) Inventors: Gunnar Behrens, Kiel (DE); Lars Paulsen, Hollingstedt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/360,505

(22) Filed: Feb. 6, 2003

(65) Prior Publication Data

US 2003/0170100 A1 Sep. 11, 2003

(30) Foreign Application Priority Data

Mar. 5, 2002 (DE) ..... 102 09 602

(51) Int. Cl.[7] ..... B65H 83/00; B65H 5/00

(52) U.S. Cl. ..... 414/416.03; 414/416.05; 271/164

(58) Field of Search ..... 414/416.03, 416.04, 414/416.05, 811; 271/162, 164

(56) References Cited

U.S. PATENT DOCUMENTS 4,775,138 A * 10/1988 Muller ..... 271/9.07
4,815,721 A * 3/1989 Morgan ..... 271/4.01
5,100,123 A * 3/1992 Kagiura et al. ..... 271/164
5,593,152 A * 1/1997 Wirth et al. ..... 271/241
2003/0011123 A1 1/2003 Behrens et al.

FOREIGN PATENT DOCUMENTS

| | | |
|---|---|---|
| DE | 42 05 595 C2 | 12/1992 |
| DE | 101 34 151 A1 | 1/2003 |
| EP | 0 822 454 A1 | 2/1998 |
| GB | 2 252 960 A | 8/1992 |

* cited by examiner

*Primary Examiner*—Kathy Matecki
*Assistant Examiner*—Mark A. Deuble
(74) *Attorney, Agent, or Firm*—Laurence A. Greenberg; Werner H. Stemer; Ralph E. Locher

(57) ABSTRACT

The invention includes a method and a device for transferring storage containers, especially cassettes for printing plates, in order to reliably and accurately receive both manually inserted cassettes and cassettes from upstream transport systems and upstream storage devices, such as MCLs. The invention enables these cassettes to be supplied to other devices constructed, for example, for separating printing plates. The storage containers are aligned in a holder provided for them, and are positioned and secured against inadvertent withdrawal. In this case, the transport of the storage containers within the device is carried out in a damped manner and can be assisted automatically. A pneumatic drive system is preferably used for this purpose.

18 Claims, 6 Drawing Sheets

METHOD AND DEVICE FOR TRANSFERRING STORAGE CONTAINERS, PREFERABLY CASSETTES FOR PRINTING PLATES

BACKGROUND OF THE INVENTION

Field of the Invention

The invention relates to a method of transferring storage containers, especially cassettes for printing plates, preferably into an appliance for separating flat elements from the storage containers.

Furthermore, the invention relates to a device for transferring storage containers, especially cassettes for printing plates, preferably in an appliance for separating flat elements from the storage containers.

In order to set images on printing plates, devices are used, especially for a plate exposer, which permit automatic changing of the printing plates. For this purpose, the printing plates are supplied from a magazine to the plate exposer. Inserted into this magazine, depending on the embodiment, are individual printing plates or cassettes which can store a plurality of printing plates. In order to remove the printing plates from such a cassette, a device for separating printing plates, as proposed in Published German Patent Application DE 101 34 151.2, can be used.

The advantage of using cassettes for the automatic printing plate change of a plate exposer resides in the fact that manual intervention in the operating sequences is needed less frequently, and that the cassettes protect the printing plates against irradiation by light and therefore against unintended exposure.

The cassettes can be supplied to the plate exposer individually and manually or alternatively further devices can be placed in front, which supply the plate exposer appropriately with cassettes. It is then possible, for example, for a loading appliance known as a multi-cassette loader (MCL) to be used, which stores a plurality of cassettes. The cassettes can then also contain printing plates of different formats.

A device which is equipped with an automatic loading appliance has been disclosed, for example, in Published European Patent Application EP 0 822 454 A1. In this device, a plurality of cassettes are stored within a provisioning device (handler). The printing plates are then also separated within this provisioning device and can then be supplied to the exposer via a holding device.

The two possibilities of supplying a plate exposer manually or automatically with cassettes have their advantages, but also their disadvantages.

If a plate exposer is loaded manually with cassettes, then this is more cost-effective in terms of procurement than if a further device has to be provided for this purpose. On the other hand, labor and time are expended for such loading. Manual loading of the plate exposer with cassettes also proves to be problematic because of the considerable weight of the cassettes (about 120 kg). It is necessary to use at least a transport table, a trolley or the like in order to load the plate exposer.

If the cassettes are supplied manually to the separator, then they will generally not be fitted in very exactly, and the separator can then have problems separating the printing plates from the cassette.

If the cassettes are already transported with a cassette transport system placed in front, the cassettes cannot be guided simply into the separator during manual loading—an operation is always necessary to accept and pass on the cassette. This means a higher expenditure on labor.

A disadvantage of automatically supplying a plate exposer with cassettes lies, for example, in a limited compatibility of the individual components. The storage of cassettes and their provision within a provisioning device like that in Published European Patent Application EP 0 822 454 A1 is therefore, for example, incompatible with various separators, for example even with that proposed in Published German Patent Application DE 101 34 151.2. It is not possible for any cassettes to be accepted from a transport system connected upstream. Furthermore, it is not possible to use this device only to some extent, if, for example, there is a desire for manual loading of the separator. Here, too, the use of MCLs for storage is not possible, since here the provisioning device is already permanently installed in the device.

SUMMARY OF THE INVENTION

It is accordingly an object of the invention to provide a method and a device for transferring storage containers, which overcome the above-mentioned disadvantages of the prior art methods and devices of this general type.

In particular, it is an object of the invention to provide a method and a device for transferring storage containers, especially cassettes for printing plates, in order to reliably and accurately supply both manually inserted cassettes to other devices, especially devices for separating printing plates, and also to be able to accept cassettes from transport systems placed upstream and from storage devices, such as MCLs.

With the foregoing and other objects in view there is provided, in accordance with the invention, a method for transferring a storage container into a device, preferably into a device for separating flat elements from the storage containers. The method includes aligning and positioning the storage container in a holder provided for the storage container and securing the storage container against inadvertent withdrawal from the holder.

In accordance with an added mode of the invention, the storage container is provided as a cassette for printing plates.

In accordance with an additional mode of the invention, the method includes coupling the storage container into the holder in a manner damped against a direction of movement of the storage container.

With the foregoing and other objects in view there is also provided, in accordance with the invention, a device for transferring storage containers, especially cassettes for printing plates, preferably into an appliance for separating flat elements from the storage containers. The device for transferring storage containers has a plurality of drive elements, at least to assist with the transfer of a storage container, and a plurality of alignment elements for aligning the transferred storage container.

The method and the device make it possible for operating personnel always to be secure in their dealings with the heavy cassettes for printing plates. Even in the event of a power failure, all the movements of the cassette are still damped. Another advantage resides in an alignment of the cassette which is simple and carried out automatically and independently by the device. By using the same device, the cassette is also secured during its use in such a way that it can no longer be moved or displaced. In addition, the transfer of cassettes to devices arranged downstream can also be carried out completely automatically. Manual loading is at least assisted.

In terms of the method, the storage containers should be coupled in a manner damped against their direction of movement within the holder provided for them. In this case, the transfer of the storage containers, either by a device placed in front or by operating personnel, is carried out in a manner which advantageously reduces any danger. If a storage container is otherwise coupled in an undamped manner into the holder, then endangering the operating personnel cannot be ruled out.

According to the invention, provision is advantageously made to operate the drive elements as a function of pressure. As opposed to elements driven by electric motors, there are fewer wearing parts, and the replacement and maintenance intervals can therefore be correspondingly long. In addition, with regard to the development of noise, pressure operation is superior to that using electric motors.

Linear motor or voice-coil drives would also be conceivable, but would be very expensive and would not ensure any damping either.

In pressure terms, both a drive with liquids (hydraulics) and one with gases (pneumatic) can be provided. According to the invention, preference is given to the pneumatic drive since here, in the event of damage, no liquids can run out into the device.

The drive can be provided with an operating cylinder, which is coupled to connecting elements via a piston and a piston rod. The advantage of such a construction resides in the fact that, for example in the event of a pressure drop or a power failure, the pressure within the cylinder is dissipated and it then remains capable of being moved further. Possible movements of the piston are then damped, since the flow occurring during a piston movement is limited by the size and number of the outlet openings of the cylinder. The safety of a user who removes the cassette in the event of possible failures is ideally ensured in the case of a pneumatic drive by a braked or damped movement of the cassette.

According to the invention, at least one driver element is provided as a connecting element for the coupling between the drive elements, such as the operating cylinders, and the cassette. In this way, a stable connection can be produced between a cassette and the drive elements. Provision is advantageously made for the cassette to be accepted and also locked by the driver element. The further transfer of cassettes to a following device can then at least be assisted by using the driver element and the drive elements.

In order to connect the cassettes better to the driver element, provision is made for the driver element to have a hook member which can be hooked to the cassette, preferably to its underside.

A hook member of the type provided here will be hooked positively to the cassette in a simple mechanical way. Unhooking of the hook member will be prevented appropriately.

According to the invention, therefore, provision is made for the connection to be stabilized by an appropriate limitation of the movement clearance of the hook member.

Therefore, for the limitation of the movement clearance of the hook member and the guidance of the movement of the driver, the driver element is mounted on a linear guide. Furthermore, at its front end the linear guide has an inclined plane to hook the hook member forcibly to the cassette. If no cassette is located in the device, the driver element and the hook member are in a rest position. The hook member is then folded away downward on the inclined plane. It can be connected to the driver element via a rotary joint.

If a cassette is moved in the device in such a way that the driver element is displaced on the linear guide by the cassette, then the hook member is also initially guided up the inclined plane. The angle between the hook member and the straight portion of the linear guide decreases more and more in this way as the movement progresses. The hook member is ultimately located parallel to the linear guide hooking automatically into the cassette which, according to the invention, has a corresponding shape on its underside. The cassette is in this way stably coupled to the driver element and, moreover, also to the drive elements.

If the cassette is to be removed from the device again, then the fact that the driver element reaches the inclined plane is sufficient to decouple hook member and cassette. The hook member is then released from the cassette and returns back into its rest position on the inclined plane For the further alignment of cassettes, the invention provides for the cassettes to be guided on a guide element. This guide element can be constructed in practical terms in the form of at least one guide rail. The cassette then runs on the guide rail, at least assisted by the driver element. Since the driver element is mounted on the linear guide and is coupled in a stable manner to the cassette, more exact alignment of the cassette in relation to the following device is made possible by the guide rail. In particular, the invention can provide for the guide element to consist of two guide rails.

According to the invention, the alignment of the cassette is still further improved by mechanical stops at the end of the guide rails. The cassette then initially strikes at least one stop, by means of which a corresponding torque is transmitted to the cassette, so that it ultimately also strikes the further stops and in this way is finally aligned. Very exact alignment of the cassette can thus be achieved in a simple way.

An operating state detection device is preferably provided in the area of the inclined plane of the linear guide. It is intended to detect the operating state in which the device is found, specifically by determining the state of the hook member. It is moreover possible to detect whether the hook member is in a position which makes it possible for a cassette to be picked up by the device. By using an operating state detection device of this type, it is advantageous to notify an operating device, for example, that the hook member and therefore the device are not ready to pick up a new cassette. This operating state detection device can, for example, be constructed in the form of a sensor.

The operating state can be determined exactly by the state or the exact position of the driver element and/or of the hook member being detected. If the hook member and/or the driver element are in the rest position, then it can be concluded that there is no cassette within the device. Put more precisely, the readiness of the device to pick up a cassette can be concluded from this. In this case, the device can advantageously be put into a standby mode, preferably after a waiting time. If the device is ready to pick up for a relatively long time, then it is not in use and the further devices which are arranged downstream of the device will not continue to be supplied with cassettes or printing plates either during this time. If there is a cassette in the device, or if the hook member is not ready to pick up, then loading or opening of the device can be prevented. Since the rest position of the hook member is the inclined plane of the linear guide, the operating state detection device is advantageously located in the vicinity of the hook member. As soon as a cassette is located sufficiently far within the device, this fact is detected via a change in the position of the hook member and/or of the driver element.

It is also possible to imagine, for example, a light barrier being installed in this area, with which it is possible to detect whether there is a cassette in the device.

Determining the operating state of the driver, that is to say, determining whether there is a cassette within an area in which a connection between cassette and hook member is provided, is advantageous, since the operating cylinder can then automatically drive the driver element forward in such a way that the cassette is transported within the device.

It may be that such automatic transport is to be carried out only in the case where automatic loading of the device with cassettes is used. This is the case, for example, when an MCL or another transport system placed in front is used. For manual provision of the cassettes it may prove to be too risky for the cassettes to be transported automatically. If the cassette were then to be held firmly for too long, there could be the danger of crushing, for example, the operating personnel. Instead, it may be desired for the onward transport of the cassettes still to be additionally damped in the manual case. This can also be achieved easily with the device described here: if an appropriate operating state of the machine is detected, then the operating cylinder can automatically be caused to additionally damp the movement of the driver element and also of the cassette. For this purpose, it is merely necessary to cause an appropriate build up of pressure within the cylinders.

According to the invention, a first position detection device is also provided in the area of the mechanical stops at the end of the guide rails. The presence of a cassette can therefore be noted here. The cassette is still to be aligned in this area and not locked for further use. The presence of this first position detection device has the advantage that the operating cylinder can automatically be caused to align the cassette appropriately by transferring a force to the cassette against the stops and then to continue to maintain pressure in such a way that the cassette is locked firmly at this location when a cassette stays in this area and is to be used. Since the cassette is pressed against the mechanical stops by the pressure exerted on it by the operating cylinders, it is ensured that it cannot be withdrawn inadvertently from the device, for example, during the continuing operation of a device arranged downstream. Furthermore, it is also possible to report to appropriate devices placed downstream that the cassette is now available. The locking can also be canceled again, so that the cassette can be removed again, or transported out of the device. A further advantage of using a pneumatic drive can be seen here, for example, it can be ensured that the cassette can be removed from the device in the event of failure of the power or the compressed air. Since, in such a case, the gas maintaining the pressure within the cylinders would escape, the cassette is then freely moveable with restrictions. Furthermore, a further forcible condition can be set up within the device such that the cassette is automatically closed in the event of removal performed during a failure. In this way, the printing plates remain protected against unintended irradiation by light even during the removal in the event of a fault.

Furthermore, a second position detection device is provided, which is intended to be located in the area of the linear guide of the driver element. It can be arranged there, in the direction in which the cassettes are inserted into the holder of the device, behind the rest position of the driver element. With this position detection device, it is advantageously possible to detect whether an inserted cassette is located in the device in such a way that it is to be pulled automatically onward into the device. The cassette is then pulled in automatically using the operating cylinders. The driver element is then driven forward via the piston rods. Provision can further be made for the cassette to be pulled in automatically only when the cassette is not supplied manually. This may be necessary for safety grounds, in order that the danger of injury is minimized. If, therefore, an MCL is used to supply cassettes to the device, these are then pulled automatically into the holder and are subsequently also aligned and locked automatically. This position detection device can be constructed in particular as a sensor and can be rendered inactive for manual loading.

Provision can advantageously also be made for either the cassette or the guide rails, or both, to have roller elements. The cassette can then have the roller elements in the areas which rest on the guide rails. In this way, the friction which occurs between guide rails and cassette is minimized. In the case of automatic loading, power can then be saved.

If the device is used for loading cassettes for printing forms, in particular for printing plates, then it can expediently also be designated a single-cassette loader (SCL).

Other features which are considered as characteristic for the invention are set forth in the appended claims.

Although the invention is illustrated and described herein as embodied in a method and device for transferring storage containers, preferably cassettes for printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

In the following drawings, identical designations designate identical elements. For better clarity, some designations have been left out of some drawings.

Figure 1:
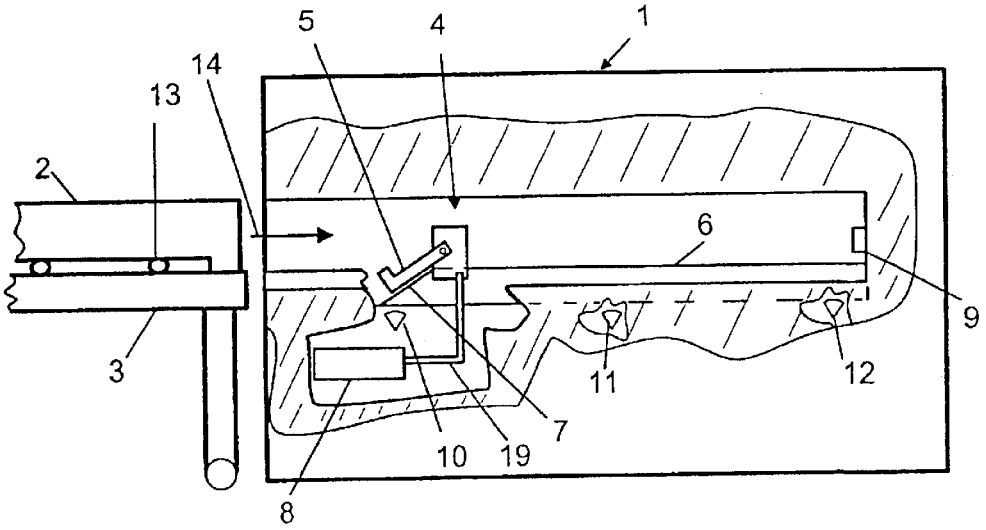
FIG. 1 is a side view of an inventive device that will be manually loaded with cassettes.

Referring now to the figures of the drawing in detail and first, particularly, to FIG. 1 thereof, there is shown a section through a device for transferring storage containers, especially cassettes 2 for printing plates, preferably in an appliance for separating flat elements from the storage containers. Since this device is used here for loading individual cassettes 2 for printing plates, it will also be designated as a single-cassette loader 1 (SCL) in the following text.

The cassette 2 is located on a trolley 3 and can be rolled on rollers 13. The cassette 2 can be pushed manually into the holder of the SCL 1 in the direction of the arrow 14. Here, the cassette 2 can strike a driver element 4 having a hook member 5.

In the position of the driver element 4 illustrated here, the driver element 4 and therefore also the hook member 5 are in a rest position. In this case, the hook member 5 lies on an inclined plane 7 belonging to a linear guide 6. The driver element 4 is mounted on the linear guide 6 and can therefore be moved only linearly.

The driver element 4 can be moved on the linear guide 6 by a piston rod 19 or else braked or damped. The drive to the piston rod 19 is provided via an operating cylinder 8. The SCL 1 can be constructed in such a way that there are two operating cylinders 8 in it, which are connected to the driver element 4 via two piston rods 19. The two operating cylinders 8 can then be provided symmetrically beside and/or below the driver element 4. If the operating cylinders 8 are in the same plane as the linear guide 6 and the driver element 4, then linear transmission of force is advantageously also possible. In the case in which two operating cylinders 8 are used, only one is visible in the illustration shown here. Preferably two operating cylinders 8 are used, which are located in the same plane as the driver element 4. Since, in this case, the side view of the device does not permit any optimum illustration of the individual constituents of the SCL 1, a position underneath the driver element 4 has been chosen for the operating cylinder 8 merely for reasons of clarity of the illustration. Furthermore, using more than two operating cylinders 8 is also conceivable.

Figure 6:
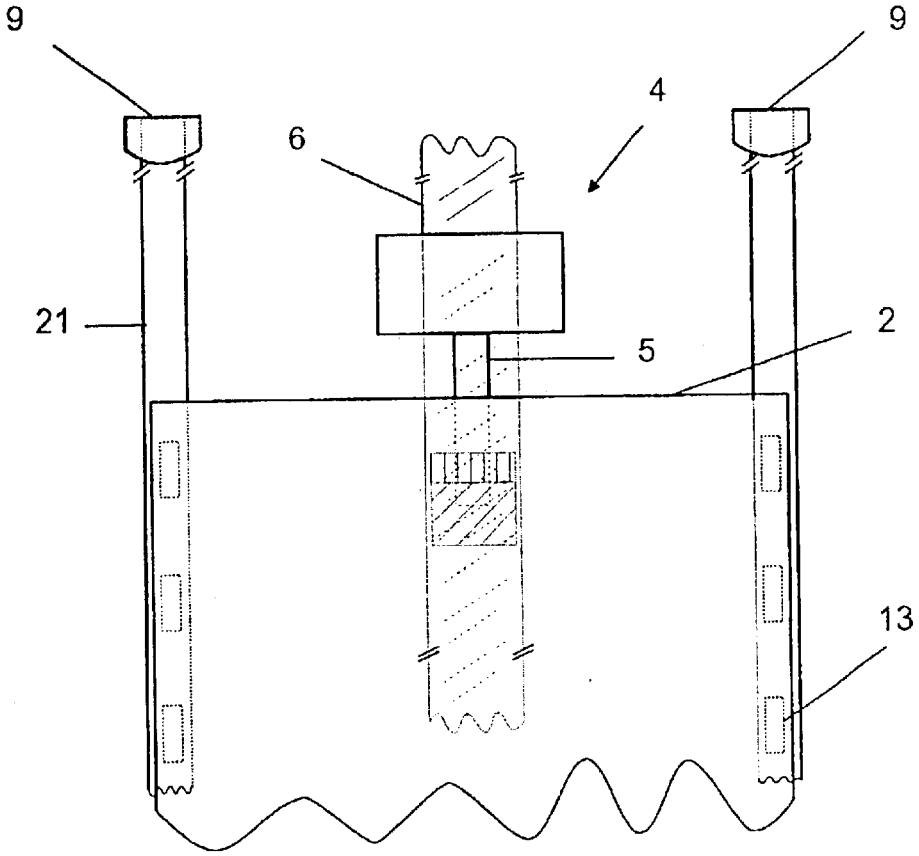
FIG. 6 is a plan view of an area of the device at the end of guide rails for the cassette.

In the vicinity of the rest position of the driver element 4 and the hook member 5, there is an operating state detection device 10, which is constructed as a sensor in this exemplary embodiment. Two further sensors are located in the vicinity of the linear guide 6. These sensors function as position detection devices 11 and 12. In this case, the first position detection device 11 is in the vicinity, preferably underneath, the linear guide 6, between the inclined plane 7 and the end of the linear guide 6. The second position detection device 12 is in the area of the end of the linear guide 6, preferably in the area of the end of guide rails 21 for the cassette 2, which are not visible in this illustration. The guide rails 21 are illustrated in FIG. 6.

Furthermore, the SCL 1 also has mechanical stops 9 at the end of these guide rails 21.

Figure 2:
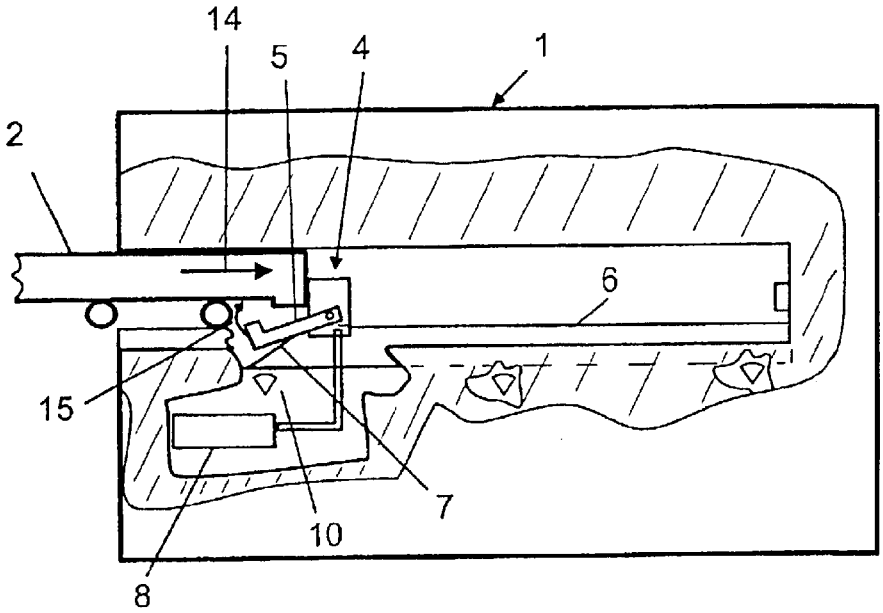
FIGS. 2–4 are side views of the device at different times during the manual loading of a cassette.
Figure 3:
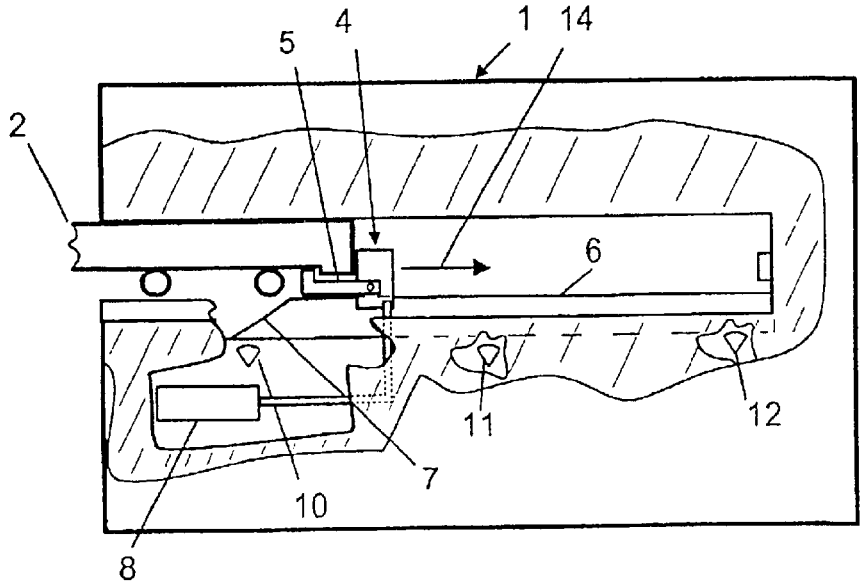
Figure 4:
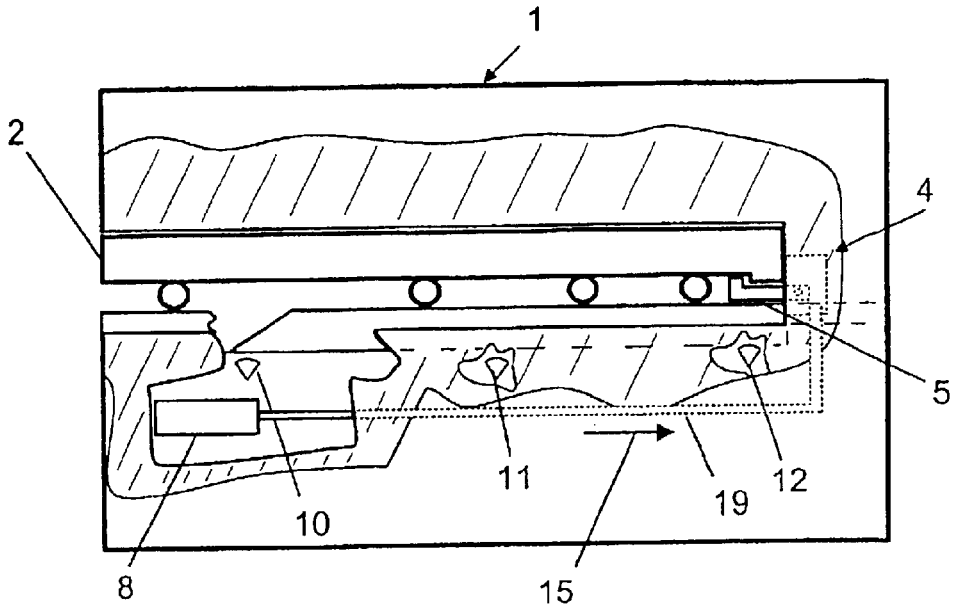

FIGS. 2 to 4 illustrate lateral views of the SCL 1 as in FIG. 1. Identical designations designate identical elements. For better clarity, some designations have been left out.

The illustration shows states during the loading of the SCL 1 with cassettes 2 at different times.

In FIG. 2, the cassette 2 is so far inside the SCL 1 that the driver element 4 is already pushed by the cassette 2 onto the linear guide 6 and the hook member 5 is moved in the direction of the cassette 2 by the movement on the inclined plane 7.

In FIG. 3, the cassette 2 is already so far within the SCL 1 the hook member 5 has already hooked into the cassette 2.

FIG. 4 represents the position of the cassette 2 at the time of possible further use. The cassette 2 is located to the maximum extent within the SCL 1 and is aligned. The operating cylinder 8 exerts a force in the direction of the arrow 15 on the driver element 4 via the piston rod 19, so that the cassette 2 is locked at this position.

Figure 5:
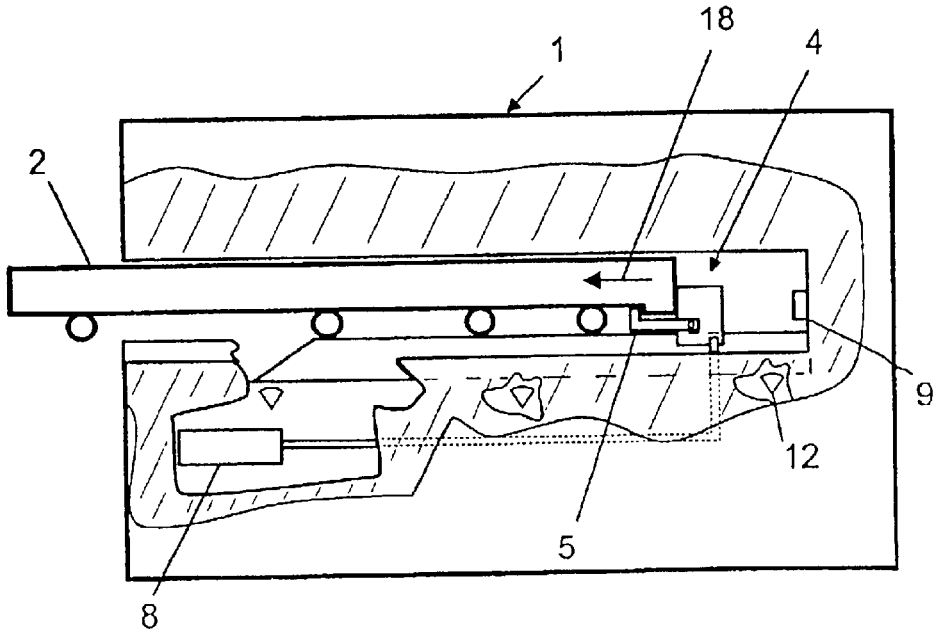
FIG. 5 is a side view of the device shown in FIG. 1 at a time during the manual removal of the cassette.

FIG. 5 shows the inventive device at a time after the completion of the further use by devices placed downstream, at least at a time when the cassette 2 will be removed from the SCL 1. By using the operating cylinder 8, the driver element 4 can be driven forward in the direction of the arrow 18, as a result of which the cassette 2 is transported in the direction out of the SCL 1.

FIG. 6 shows a plan view of an area of the SCL 1. It is possible to see the ends of guide rails 21, on which the cassette 2 is pushed into the SCL 1. It is possible to see the rollers 13 on which the cassette 2 rolls in the guide rails 21. Located in the center underneath the cassette 2 is the linear guide 6, on which the driver element 4 runs. The driver element 4 is coupled to the cassette 2 via the hook member 5. At the end of the guide rails 21 there are the mechanical stops 9, on which the cassette 2 is aligned.

Figure 7:
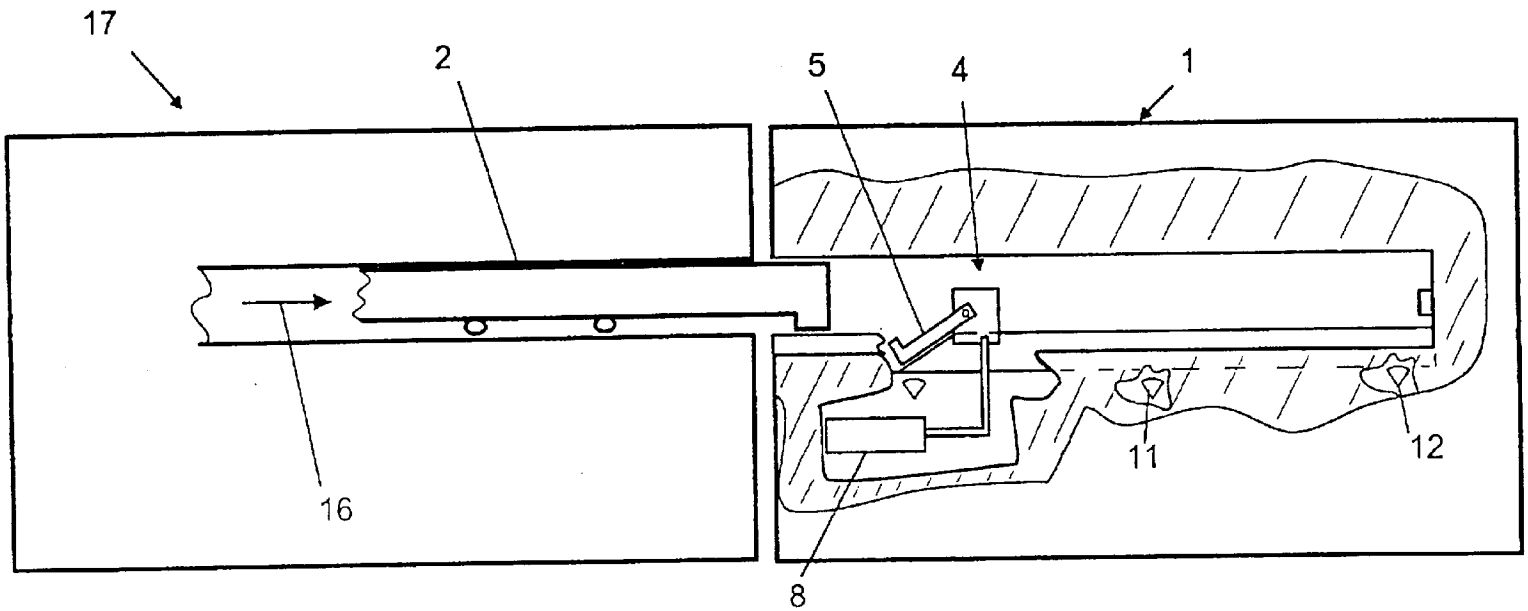
FIG. 7 is a side view of a device and a multi-cassette loader 17 (MCL) placed in front for automatically loading the device with a cassette.

FIG. 7 shows the SCL 1 in a manner analogous to FIG. 1. In this case, however, it is not loaded manually via the trolley 3 but automatically using a further device, more precisely using a multi-cassette loader (MCL 17).

The drawing illustrates the combination of MCL 17 and SCL 1 at a time at which the cassette 2 is still for the most part within the MCL 17 and is being transported automatically only by the MCL 17 into the holder of the SCL 1 in the direction of the arrow 16.

Figure 8:
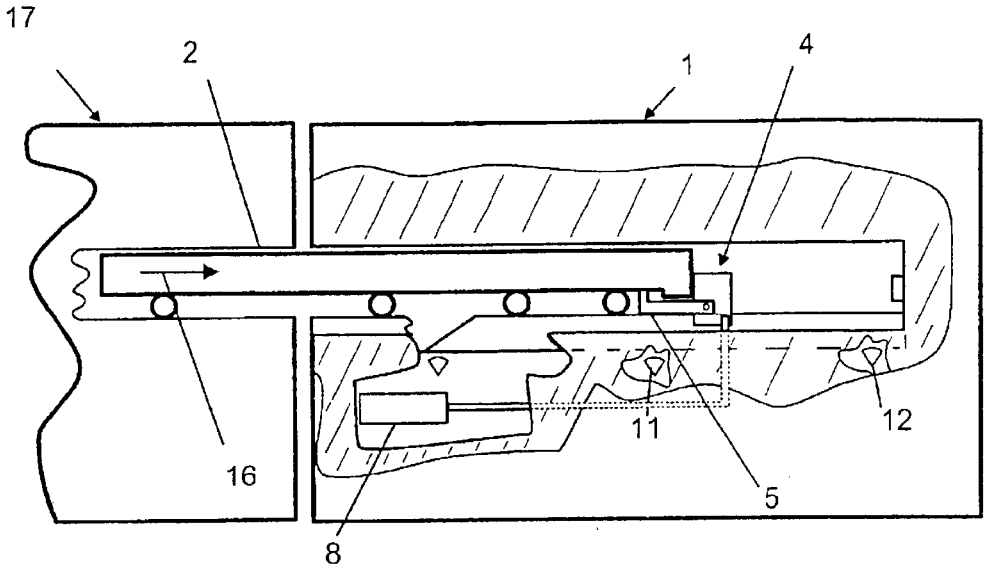
FIGS. 8–9 are side views of a combination of the device with the MCL 17 as shown in FIG. 7 at different points during the automatic loading of the device.
Figure 9:
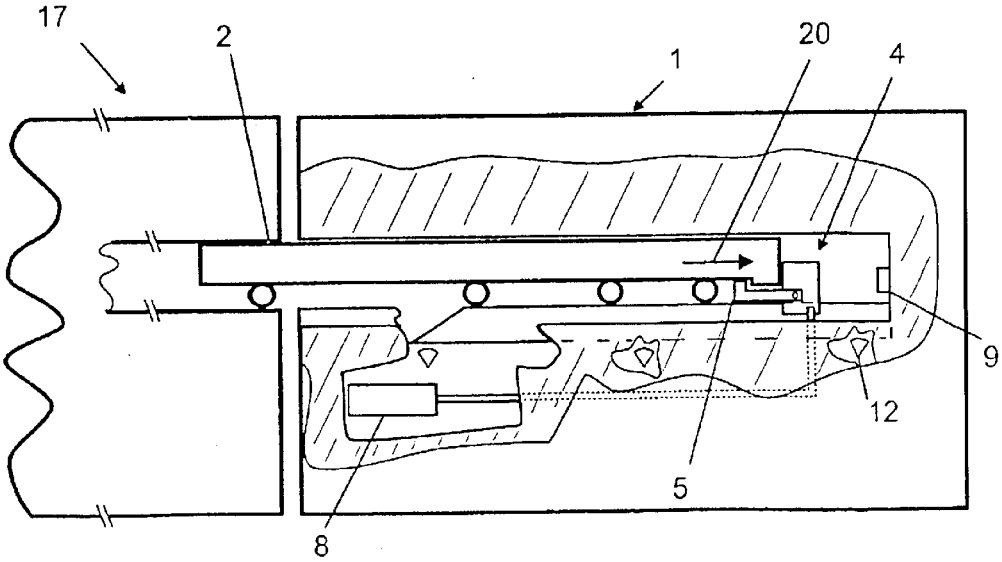

FIGS. 8 and 9 show, in a manner analogous to FIGS. 2 and 3, states during the loading of the SCL with the MCL 17 at different times.

In FIG. 8, the cassette 2 is still being driven in the direction of the arrow 16 by the MCL 17, but has already been hooked in by the driver element 4 using the hook member 5 and is already so far inside the SCL 1 that the position of the cassette 2 can be detected by the position detection device 11.

FIG. 9 illustrates the state at a time at which the cassette 2 is already being moved only by the SCL 1. The operating cylinder 8 moves the driver element 4 forward in such a way that the cassette 2 is already being moved only by the SCL 1. The operating cylinder 8 moves the driver element 4 forward in such a way that the cassette 2 is transported in the direction of the arrow 20.

Referring once again to FIG. 1, there is shown a single-cassette loader (SCL) 1 with which cassettes 2 that, for example, contain printing plates, can be transferred to other devices. In these illustrations, the SCL 1 is loaded manually. For this purpose, the cassette 2 is on a trolley 3 which, for example, can stand on rollers. In this way, the cassette 2 can easily be moved by one person and ultimately supplied to the SCL 1. For this purpose, the cassette 2 also has rollers 13 on its underside, so that the operating person can push the cassette 2 in the direction of the arrow 14 into the holder of the SCL 1. Inside the SCL 1, the driver element 4 and the hook member 5 are in a rest position, in which the hook member 5 rests on the inclined plane 7 of the linear guide 6. In this state, the devices 10 to 12 do not detect a cassette 2 within the SCL 1. The devices 10, 12 are constructed in particular as sensors. This state can be reported on to further operating elements, not illustrated, belonging to the device and/or to devices arranged downstream for the further processing of the printing plates, and for example, can be indicated there. The first sensor is the operating state detecting device 10 and indicates whether the hook member 5 is ready to pick up a cassette 2, that is to say whether the hook member 5 is in its rest position on the inclined plane 7 of the linear guide 6. Readiness of the SCL 1 to pick up can then be indicated by indicating elements, not shown. For the case in which a cassette 2 is already inside the SCL 1, but the hook member 5 is at least not ready to pick up, this can also be indicated and the corresponding supply of further cassettes 2 can be prevented. If the hook member 5, and therefore the SCL 1 also, are ready to pick up, then "standby" is detected as the state and the SCL 1 and any devices arranged downstream can be set appropriately, for example into energy-saving modes.

In FIG. 2, it can then be seen how the cassette 2 is pushed by the operating person into the SCL 1 to such an extent that the cassette 2 strikes the driver element 4. The cassette 2 moves inside the SCL 1 with the rollers 13 of the cassette 2 in guide rails 21, although these cannot be seen in this illustration; they are shown in FIG. 6.

As a result of the movement of the cassette 2 in the direction of the arrow 14, this movement is transmitted to the driver element 4. The driver element 4 is connected to the operating cylinder 8 via a piston rod 19. The movement of the cassette 2 is braked or damped via the operating cylinder 8. This is caused by the fact that the operating cylinder 8 is operated pneumatically. If the movement is not to be braked or is even to be accelerated, then quite specific pressure changes within the operating cylinder 6 are necessary. If no particular operating states within the operating cylinder are changed, then the movement of the driver element 4 is damped.

The hook member 5 is part of the driver element 4, and during its movement on the linear guide 6, is pulled up the inclined plane 7. Overall, therefore, there is a movement of the hook member 5 in the direction of the arrow 15. According to the invention, the underside of the cassette 2 has a shape for the hook member 5 such that the hook member 5 can hook into the cassette 2. In this way, the driver element 4 and the cassette 2 are coupled to each other in terms of movement.

FIG. 3 shows the state in which the cassette 2 is coupled to the driver element 4 via the hook member 5. The forward movement in the direction of the arrow 14 is still being caused here as a result of being pushed in by the operating person. Since the movement of the cassette 2 is transmitted via the piston rod 19 to the piston (not shown) within the operating cylinder 8, the movement of the cassette 2 is damped as described above. This damping applies to both types of movement, both into the SCL 1 and out of the latter. As a result, safe operation of the SCL 1 is ensured.

The cassette 2 can now be pushed manually into the SCL 1 to such an extent that it is detected by the position detection device 11. The detection by the position detection device 11 means that it is now possible for a pressure to be built up within the compressed-air cylinder 8 so that the piston drives the piston rod 19 forward in the direction of the arrow 14. The further movement of the cassette 2 is then automatically assisted by the SCL 1 or even performed entirely, so that no more effort is needed.

Furthermore, there is also the possibility, by contrast, to damp the forward movement in the direction of the arrow 14 still further. This may be desired in order to further reduce any possible danger to the operating personnel which could be caused by possible crushing of the hands as a result of the automatic pulling-in action. In order to damp the movement still further, an appropriate pressure can easily be built up within the operating cylinder 8. For the case of manual loading of the SCL 1, it is also possible to deactivate the position detection device 11 via operating elements, or to configure the operation in such a way that the signals from the position detection device 11 are not processed further. The pushing-in movement is then carried out progressively and equally damped.

FIG. 4 illustrates the state of the SCL 1 when an end position of the cassette 2 is reached. In this position at the end of the guide rails 21, the printing plates within the cassette 2 are made available to a device arranged downstream. The cassette 2 can have been brought manually or else automatically into the vicinity of the end of the linear guide 6, so that it is detected by the position detection device 12. By using an appropriate signal from the position detection device 12, a pressure can be caused to build up within the operating cylinder 8, so that the cassette 2 is pressed against the mechanical stops 9, which were shown in the previous figures, and locked in this position. The cassette 2 is aligned exactly by the stops 9. This is because, in the event of a corresponding misalignment of the cassette 2, first of all only one side of the cassette strikes a stop 9, then it is driven forward, by the transmission of force in the direction of the arrow 15 by the piston rod 19 onto the driver element 4 and therefore onto the cassette 2, to such an extent that it will rotate about the point of contact between stop 9 and cassette 2 until the other side of the cassette 2 is also forced against the second stop 9. In this way, very exact alignment of the cassette 2 within the SCL 1 occurs. Since the transmission of force from the operating cylinder 8 to the driver element 4 is also carried out in the direction of the arrow 15, the cassette 2 remains aligned and can no longer be displaced or otherwise adjusted and remains in this position until the pressure within the operating cylinder 8 is changed appropriately. For example, it can be reduced in order to permit slow removal, or the pressure can be built up on the other side of the piston within the operating cylinder 8, so that the cassette 2 moves automatically, at least to some extent, out of the SCL 1. Without a change in the state of the operating cylinder 8, the cassette 2 cannot be moved, and in particular inadvertent removal of the cassette 2 from this position is not possible.

Once the cassette 2 is locked at the end of the linear guide 6 or, more accurately, pressed against the stops 9 which are located at the end of the guide rails 21, the cassette 2 can be used by further devices placed downstream. The position detection device 12 then outputs an appropriate signal to the devices arranged downstream. For example, the SCL 1 can be integrated in a plate separator, as proposed in Published German Patent Application DE 101 34 151.2. The cassette 2 can then be opened automatically and the plates can be removed from the cassette 2 as described in the aforementioned application. During this entire operation, the plates initially remain within the cassette 2 and are also protected within the SCL 1 against light radiating in.

If, at this time or at any arbitrary later or earlier time, the power or the compressed-air supply for the SCL 1 should fail, then the cassette 2 can easily be removed manually from the SCL 1. Since the flow velocity of the air within the operating cylinder 8 is limited, every movement of the cassette 2 remains damped, until it is uncoupled from the driver element 4. The safety of the operating personnel therefore remains ensured.

Should the cassette 2 still be open before the removal in the event of a failure, then it is possible to insure in a simple manner, by using appropriate forcible measures, that the cassette 2 is closed again during the removal, so that the protection of the printing plates from light continues to be maintained.

FIG. 5 shows the state at a time at which the further use of the cassette 2 has been completed. The cassette 2 has then been closed and can be transported out of the SCL 1. For this purpose, the pressure within the compressed-air cylinder 8 can be dissipated, so that the cassette 2 can be moved manually in a damped manner.

In a further advantageous embodiment of the invention, it is ensured that the cassette 2 is automatically moved out of the SCL 1 in the direction of the arrow 18 by using the operating cylinder 8. This movement can be continued until the cassette 2 has been pushed out of the SCL 1 by an intended distance, for example 20 cm, and can then be removed manually again. Provision is further made that, in the case of the automatic movement of the cassette 2 out of the SCL 1, the automatic movement is at least interrupted when the cassette 2 is still coupled to the driver element 4. For this purpose, in particular, the position detection device 11 can be designed in such a way that, for the case in which a cassette 2 is no longer detected, the pressure within the compressed-air cylinder 8 is automatically dissipated. The cassette 2 can then be moved in a damped manner.

FIG. 6 is a plan view of the area of the SCL 1 in which the ends of the guide rails 21 are found. The driver element 4 is moved on the linear guide 6. Since the driver element 4 is coupled to the cassette 2 via the hook member 5, the cassette 2 is also moved with the driver element 4. The cassette 2 moves on the guide rails 21 with the assistance of the rollers 13 on its underside. By means of the rollers 13, the friction of the cassette 2 on the guide rails can be reduced. If the cassette 2 is not yet correctly aligned to this position, then this is corrected at the end of the guide rails 21. For this purpose, there are mechanical stops 9 at the ends of the guide rails 21.

If the cassette 2 is located in a position from which it is transported onward in the direction of the end of the guide rails 21 for further use by another device, it is moved out from there by the driver element 4. The movement can be carried out both manually and automatically with the assistance of the operating cylinder 8, which is not illustrated in this drawing. In the case of a manual movement, this can be damped in accordance with the previous explanations.

If the cassette 2 is not yet correctly aligned during this forward movement, then that corner of the cassette 2 which is further forward strikes a mechanical stop 9 first. The cassette 2 is then moved further onward by the driver element 4. In this way, the cassette 2 is rotated such that the other side also strikes a mechanical stop 9. Both sides of the cassette 2 are then at one level. The cassette 2 can then be locked in this position by the operating cylinder 8 until further use by a device placed downstream is concluded. The pressure within the operating cylinder 8 is then dissipated again or built up on the other side of the piston within the operating cylinder 8 in such a way that the cassette 2 is transported out of the SCL 1 again.

FIGS. 7 to 9 illustrate the steps of loading an SCL 1 by using a multi-cassette loader (MCL) 17. The operation substantially corresponds to that which has already been described for the manual loading of the SCL 1 in FIGS. 1 to 4. However, in this case the cassette 2 is driven forward into the SCL 1 by the MCL 17.

In FIG. 7, the cassette 2 is still for the major part within the MCL 17, in which there may also be still more cassettes 2, for example also having different plate sizes. The MCL 17 then drives the cassette 2 automatically into the SCL 1 in the direction of the arrow 16 when requested by operating devices, not illustrated.

Inside the SCL 1, the driver element 4 and the associated hook member 5 are in the rest position and are detected there by the operating state detection device 10. Only in this case is it possible for the SCL 1 to be loaded at all. The operating electronics then receive a corresponding signal which refers to the operating state (here: unloaded). The MCL 17 is advantageously coupled to the operating electronics of the SCL 1, and a corresponding movement of the cassette 2 by the MCL 17 is permitted only when the SCL 1 is unloaded. The SCL 1 is then in the standby mode.

Starting at a specific insertion depth, within the SCL 1 the cassette 2 encounters the driver element 4 which is mounted on the linear guide 6. The further forward movement of the cassette 2 by the MCL 17 is then damped. After a further distance, the cassette 2 has been pushed into the SCL 1 to such an extent that the hook member 5 has been pushed upward, as a result of the movement on the inclined plane 7, to such an extent that it hooks into the cassette 2. The cassette 2 has then been gripped by the SCL 1.

At a deeper insertion depth, the cassette 2 and/or the driver element 4 is detected by a position detection device 11. This state is shown in FIG. 8. The operating cylinder 8 is then caused by the operating electronics to perform the onward transport of the cassette 2. The MCL 17 can then be controlled to not drive the cassette 2 further forward and to cancel any connection with the cassette 2.

FIG. 9 shows how the cassette 2 was initially taken over by the SCL 1. The operating cylinder 8 drives the cassette 2 forward in the direction of the arrow 20 within the SCL 1. The speed at which the cassette 2 is transported is in this case about 100 mm/s. As is also the case during manual loading, at the end of the guide rails 21 the cassette 2 encounters the mechanical stops 9, on which it is then aligned. Pressure is then also exerted by the operating cylinder 8, so that the cassette 2 remains locked in this position and its content can be made available.

After the cassette 2 has been used by the device placed downstream, the cassette 2 can then be pushed out automatically, as also already described for the manual loading of the SCL 1 in FIG. 5. After a certain distance, for example after 20 cm, the cassette 2 can then be taken over again by the MCL 17, which is then responsible for the movement of the cassette 2. The operating cylinder 8 again ensures a damped movement until the hook member 5 releases the cassette 2 when the member reaches the inclined plane 7 of the linear guide 6.

The cassette 2 is then again in the MCL 17 and the driver element 4 with the hook member 5 are again in their rest positions in the SCL 1. The operating state detection device 10 detects the driver element 4 and/or the hook member 5 in this position, and the SCL 1 is in a standby mode and is ready to be loaded again.

We claim:

1. A device for transferring a storage container, the device comprising:

a plurality of drive elements at least for assisting with the transferring of the storage container;

a plurality of alignment elements for aligning the storage container after the storage container has been transferred;

at least one driver element for holding and locking the storage container, said at least one driver element: being connected to said plurality of drive elements; and having a hook member for hooking to the storage container; and a linear guide having an inclined plane for guiding said at least one driver element, said inclined plane forcibly hooking said hook member to the storage container.

2. The device according to claim, 1 in combination with the storage container, wherein the storage container is a cassette for printing plates.

3. The device according to claim, 1 in combination with a mechanism for separating flat elements of the storage container, wherein the device transfers the storage container into the mechanism for separating the flat elements.

4. The device according to claim 1, in combination with the storage container, wherein the storage container is a cassette for printing plates.

5. The device according to claim 1, wherein said drive elements operate as a function of pressure.

6. The device according to claim 1, wherein said drive elements pneumatically operate as a function of pressure.

7. The device according to claim 6, wherein said plurality of drive elements are a plurality of operating cylinders.

8. The device according to claim 1, wherein said plurality of drive elements are a plurality of operating cylinders.

9. The device according to claim 1, wherein said hook member of said driver element hooks to an underside of the storage container.

10. The device according to claim 1, wherein said linear guide has a mechanical compulsion device for forcibly hooking said hook member to the storage container.

11. The device according to claim 1, wherein at least one of said plurality of alignment elements is constructed as a guide element.

12. The device according to claim 1, wherein at least one of said plurality of alignment elements is constructed as a guide rail.

13. The device according to claim 12, comprising an alignment element formed as a mechanical stop; said guide rail having an end; and said mechanical stop located at said end of said guide rail.

14. The device according to claim 1, comprising:

said driver element connected to said plurality of drive elements, a mechanical compulsion device for forcibly hooking said hook member to the storage container; and an operating state detection device for detecting a readiness of said hook member to pick up the storage container;

said operating state detection device located near said mechanical compulsion device.

15. The device according to claim 1, comprising:

at least one alignment element constructed as a guide rail having an end;

an alignment element formed as a mechanical stop located at said end of said guide rail; and a first position detection device for detecting a position of the storage container; said first position detection device located near said mechanical stop.

16. The device according to claim 1, in combination with the storage container, wherein the storage container includes plurality of roller elements for reducing friction.

17. The device according to claim 1, comprising:

at least one alignment element constructed as a guide rail; and a plurality of roller elements for reducing friction;

said plurality of roller elements configured on said guide rail.

18. A device for transferring a storage container, the device comprising:

a plurality of drive elements at least for assisting with the transferring of the storage container;

a plurality of alignment elements for aligning the storage container after the storage container has been transferred;

a position detection device for detecting whether the storage container is in a position necessary for automatically pulling in the storage container;

at least one driver element for holding and locking the storage container, said driver element connected to said plurality of drive elements;

a linear guide having an inclined plane for guiding said driver element, said inclined plane for forcibly hooking said hook member to the storage container; and said position detection device located near said linear guide, behind an initial position of said driver element in a transport direction of the storage container.

* * * * *